United States Patent [19]

Rock

[11] Patent Number: 4,752,341

[45] Date of Patent: Jun. 21, 1988

[54] PIGMENT SYSTEM FOR PAPER

[75] Inventor: Steven L. Rock, Doylestown, Pa.

[73] Assignee: PQ Corporation, Valley Forge, Pa.

[21] Appl. No.: 56,035

[22] Filed: Jun. 1, 1987

Related U.S. Application Data

[63] Continuation-in-part of Ser. No. 895,068, Aug. 11, 1986, abandoned.

[51] Int. Cl.[4] ..... C09C 1/36

[52] U.S. Cl. ..... 106/300; 423/328

[58] Field of Search ..... 106/299, 300; 423/328

[56] References Cited

U.S. PATENT DOCUMENTS

| | | | |
|---|---|---|---|
| 3,658,566 | 4/1972 | Sheehan et al. | 106/300 |
| 4,199,370 | 4/1980 | Brand | 106/300 |
| 4,227,935 | 10/1980 | Blake et al. | 106/300 |

*Primary Examiner*—A. Lionel Clingman
*Assistant Examiner*—Wille J. Thompson
*Attorney, Agent, or Firm*—Ernest G. Posner; J. S. Stephen Bobb; Fred C. Philpitt

[57] ABSTRACT

Zeolite of a small controlled particle size has been found to be a pigment component to be used with $TiO_2$ in papermaking. Zeolite A wherein the sodium has been at least partially replaced with calcium and/or hydronium ion is widely useful with $TiO_2$ in papermaking.

12 Claims, No Drawings

PIGMENT SYSTEM FOR PAPER

This application is a continuation-in-part of my copending U.S. patent application Ser. No. 895,068, filed Aug. 11, 1986, abandoned 8/14/87.

BACKGROUND OF THE INVENTION

This invention relates to papermaking and to particulate additives useful therein. Specifically, this invention involves a combination of titanium dioxide and zeolite which provides excellent properties when included in paper.

Paper is essentially a composite of various cellulose fibers with various particulate materials included therein for various reasons. In particular, white materials of low abrasivity are desired. Such materials should improve the optical properties of the paper such as brightness and opacity. Titanium dioxide is a very desirable material, providing outstanding whiteness as well as other optical qualities to various white papers. However titanium dioxide is an expensive material, and finding materials that can complement its contribution in papermaking has been difficult.

Japanese patent application No. Sho 45-41044 with a disclosure date of Dec. 23, 1970, teaches that paper can be made using a natural zeolite as a filler, but only if the material is considerably refined. French Pat. application No. 80 24735 with publication No. 2,494,736 and publication date May 28, 1982, teaches that Zeolite NaA can be used as a partial replacement for $TiO_2$ in paper. While paper can be made with such systems, there are various problems associated with the process. The chemistry of Zeolite NaA is not conducive to all papermaking methods and may require undesirable additions of other ingredients.

It is an object of this invention to provide an improvement to the process of making paper using zeolite, said improvement being an altered chemistry for Zeolite A and/or carefully controlling the particle size.

SUMMARY OF THE INVENTION

I have found that a pigment system comprising zeolite and $TiO_2$ added during papermaking provides paper of excellent quality at reduced cost and without requiring additional processing steps over papermaking processes that presently use $TiO_2$. The zeolite is of small particle size and of small well-controlled crystallite size. The average particle size of the zeolite should be less than 3 microns with a crystallite size of less than 1 micron.

The chemistry of the zeolite is altered by at least partially replacing sodium with calcium and/or by pH-adjusting the material.

THE INVENTION

The zeolites required for compositions of my invention are crystalline aluminosilicates such as Zeolite A. The preparation and properties of these zeolite are described in detail in U.S. Pat. No. 2,882,243 among other sources. This patent is incorporated herein by reference. Generally, this preparation involves combining aqueous sources of silica, alumina and sodium to produce a gel which is crystallized upon hydrothermal treatment.

Other zeolites can be used in the combination of my invention as long as they provide the desired properties that apparently rsult from the particle size and crystal sizes defined hereinafter. Other synthetic crystalline aluminosilicates are useful, such as Zeolite C.

The particle and crystal size of the zeolite is very important in the composition of my invention. The average particle size should be no more than about 3 microns, and preferably about 1.5 to 2.5 microns. The crystal size should be about $\frac{1}{3}$ of the average particle size, and certainly no more than about 1 micron. I prefer a crystal size of about 0.2 to 0.8 microns. Zeolite A having these preferred characteristics is a preferred component of the pigment composition. If the particle and crystal size are larger than those specified, the quality of the resulting paper is much reduced.

The hydrated Zeolite NaA realized from the process of U.S. Pat. No. 2,882,243 may be modified with the substitution of calcium for part of the sodium. The calcium modification is carried out by ion exchange in aqueous solution using nearly any appropriate calcium salt such as $CaCl_2$, $Ca(NO_3)_2$, $CaSO_4$ and the like. The exchange can be carried out in any convenient manner that allows control of the amount of calcium exchanged for sodium. Up to 80% calcium exchange can be effective; I prefer the zeolite to have about 5 to 60% of the sodium replaced with calcium. I most prefer that about 10 to 40% be calcium. Washing and filtering removes the sodium and completes the preparation. The zeolites resulting from this process can be conveniently represented by the following notation:

$$\text{Zeolite } (Ca_xNa_{12-x/2})A.2H_2O$$

wherein x can be up to about 4.8, with about 0.3 to 3.6 and about 0.6 to 3.0 corresponding to the preferred and most preferred ranges.

Zeolites are alkaline materials, and in papermaking processes such strong alkalinity can be a disadvantage. In these processes pH-adjusted zeolites or pH-adjusted zeolites with the proper calcium/sodium balance are useful. The pH adjustment is carried out on zeolite NaA or the exchanged materials. The calcium content for the Ca exchanged materials prior to the pH treatment can be somewhat less than that of the previous materials described. such zeolites can be represented by the notation:

$$\text{Zeolite } (Ca_xNa_{12-x/2})A$$

wherein x can be 0.9 to 4.8. The zeolites are pH-adjusted by slurrying in water and adding acid slowly until the pH is between about 4.5 and 9.5. Mineral acids such as $H_2SO_4$ and HCl are usually used for this technique. The acidified slurry is aged for 30 to 90 minutes. Washing, filtering and drying complete the preparation. The composition of zeolites treated in this manner can be represented as:

$$\text{Zeolite } [Ca_xNa_{12-(x/2+y)}H_y]A \cdot zH_2O$$

wherein x is about 0 to 4.8 and y is about 0.6 to 2.5, or x can be 0.6 to 2.6 with y being 0.6 to 2.2. In both of these formulas z can be 8 to 250, usually about 20 to 27.

$TiO_2$ is a commercial product usually prepared from titanium-containing ores by the sulfate or chloride process. The composition of my invention can accommodate both the generally available organic coated materials and the uncoated ones which are currently used in the papermaking industry.

The pigment system of my invention consists of about 10 to 90% $TiO_2$ and 90 to 10% of the zeolite on a weight basis. It is incorporated into the paper in the same manner that any pigment or filler is added. The finished paper has excellent properties including brightness and opacity, and compares very favorably economically with the use of $TiO_2$ alone.

EXAMPLES

The following examples illustrate certain embodiments of our invention. These examples are not provided to establish the scope of the invention, which is described in the disclosure and recited in the claims. The proportions are in parts by weight based on the weight of the paper (pbw) or percent by weight (% wt/wt) unless otherwise indicated.

A pilot plant papermaking machine was employed in producing paper from a furnish of 70 pbw hardwood and 30 pbw softwood fiber. Alum (1 pbw) and dispersed rosin size (1 pbw) was added to produce a slack-sized sheet. An additional amount of alum was added to set the size. Sufficient cationic retention aid was added to obtain pigment retention levels of approximately 80%.

The following pigment systems were added to the paper with addition levels of 4, 8 and 12%.

1. $TiO_2$
2. 50% $TiO_2$/50% Zeolite A(I)
3. 50% $TiO_2$/50% Zeolite A(II)
4. 50% $TiO_2$/50% Commercial $TiO_2$ extender pigment (precipitated amorphous aluminosilicate)

Zeolite A (I) has an average particle size of 4.5 microns and a crystallite size of 1.7 microns.

Zeolite A (II) has an average particle size of 2.5 microns and a crystallite size of 0.7 microns.

Various standard tests were carried out on the paper prepared. The results are summarized in the following tables.

TABLE I

| Pigment System | Brightness (%) Loading Retained in Paper 4% | 7% | 10% |
|---|---|---|---|
| 1 | 86.0 | 87.0 | 88.0 |
| 2 | 84.0 | 85.0 | 86.0 |
| 3 | 85.0 | 86.0 | 86.5 |
| 4 | 84.5 | 86.5 | 86.5 |

TABLE II

| Pigment System | Opacity (%) Loading Retained in Paper 4% | 7% | 10% |
|---|---|---|---|
| 1 | 90.5 | 92.5 | 94.0 |
| 2 | 89.0 | 90.5 | 91.5 |
| 3 | 89.5 | 91.0 | 93.0 |
| 4 | 90.0 | 91.0 | 92.5 |

TABLE III

| Pigment System | Pigment Scattering Factor ($cm^2/g$) Loading Retained in Paper 4% | 7% | 10% |
|---|---|---|---|
| 1 | 4850 | 4900 | 4450 |
| 2 | 2700 | 3000 | 2950 |
| 3 | 3750 | 3700 | 3400 |
| 4 | 3550 | 3550 | 3500 |

TABLE IV

| Pigment System | Machine Direction Breaking Length (km) Loading Retained in Paper 4% | 7% | 10% |
|---|---|---|---|
| 1 | 2.8 | 2.2 | 1.7 |
| 2 | 2.9 | 2.4 | 2.0 |
| 3 | 2.9 | 2.4 | 2.0 |
| 4 | 2.6 | 2.1 | 2.0 |

These results indicate that the Zeolite A with the small particle size has considerable advantage over the larger size Zeolite A as a pigment system component. The behavior of the small particle zeolite in combination with $TiO_2$ is comparable with the commercial product being used.

Pigment systems containing 90% by weight of $TiO_2$ and 10% by weight of zeolite can be expected to have similar favorable results when compared with the current methods of use of $TiO_2$ in the paper industry.

Pigment systems containing 10% by weight of $Ti_2$ and 90% by weight of zeolite will yield results favorable to the current methods of using $TiO_2$ in paper on an economic basis, and they provide satisfactory performance.

I claim:

1. A pigment system for paper comprising: titanium dioxide ($TiO_2$) and zeolite of less than 3 micron average particle size and an average crystal size of less than 1 micron.

2. The pigment system of claim 1 wherein there is 10 to 90% by weight of the $TiO_2$ and 90 to 10% by weight of the zeolite.

3. The pigment system of claim 1 wherein the zeolite has an average particle size of 1.5 to 2.5 microns and an average crystal size of 0.2 to 0.8 microns.

4. The pigment system of claim 2 wherein the zeolite is Zeolite A which has an average particle size of 1.5 to 2.5 microns and an average crystal size of 0.2 to 0.8 microns.

5. The pigment system of claim 1 wherein the zeolite has the following composition:

$$\text{Zeolite } (Ca_xNa_{12-x/2})A\ zH_2O$$

wherein x can be up to about 4.8 and z can be 20 to 27.

6. The pigment system of claim 2 wherein the zeolite has the following composition:

$$\text{Zeolite } (Ca_xNa_{12-x/2})A\ zH_2O$$

wherein x can be about 0.3 to 3.6 and z can be 20 to 27.

7. The pigment system of claim 3 wherein the zeolite has the following composition:

$$\text{Zeolite } (Ca_xNa_{12-x/2})A\ zH_2O$$

wherein x can be about 0.3 to 3.6 and z can be 20 to 27.

8. The pigment system of claim 4 wherein the zeolite has the following composition:

$$\text{Zeolite } (Ca_xNa_{12-x/2})A\ zH_2O$$

wherein x can be about 0.3 to 3.6 and z can be 20 to 27.

9. The pigment system of claim 1 wherein the zeolite has the following composition:

$$\text{Zeolite } [Ca_xNa_{12-(x/2+y)}Hy]\ zH_2O$$

wherein x can be 0 to about 4.8, y is about 0.6 to 2.5 and z is 20 to 27.

10. The pigment system of claim 2 wherein the zeolite has the following composition:

$$\text{Zeolite } [Ca_xNa_{12-(x/2+y)}H_y]\ zH_2O$$

wherein x can be 0 to about 4.8, y is about 0.6 to 2.5 and z is 20 to 27.

11. The pigment system of claim 3 wherein the zeolite has the following composition:

$$\text{Zeolite } [Ca_xNa_{12-(x/2+y)}H_y]\ zH_2O$$

wherein x can be 0 to about 4.8, y is about 0.6 to 2.5 and z is 20 to 27.

12. The pigment system of claim 4 wherein the zeolite has the following composition:

$$\text{Zeolite } [Ca_xNa_{12-(x/2+y)}H_y]\ zH_2O$$

wherein x can be 0 to about 4.8, y is about 0.6 to 2.5 and z is 20 to 27.

* * * * *